US010415759B2

(12) United States Patent
Zou

(10) Patent No.: US 10,415,759 B2
(45) Date of Patent: Sep. 17, 2019

(54) CRYOSTAT FOR SUPERCONDUCTING MAGNET SYSTEM

(71) Applicant: SHANGHAI UNITED IMAGING HEALTHCARE CO., LTD., Shanghai (CN)

(72) Inventor: Lijun Zou, Shanghai (CN)

(73) Assignee: SHANGHAI UNITED IMAGING HEALTHCARE CO., LTD., Shanghai (CN)

( * ) Notice: Subject to any disclaimer, the term of this patent is extended or adjusted under 35 U.S.C. 154(b) by 0 days.

(21) Appl. No.: 15/164,876

(22) Filed: May 26, 2016

(65) Prior Publication Data

US 2017/0268726 A1 Sep. 21, 2017

(30) Foreign Application Priority Data

Mar. 18, 2016 (CN) ..... 2016 1 0158171

(51) Int. Cl.
*F17C 1/02* (2006.01)
*F17C 13/00* (2006.01)
(Continued)

(52) U.S. Cl.
CPC ..... *F17C 13/006* (2013.01); *F17C 3/085* (2013.01); *F25B 19/005* (2013.01);
(Continued)

(58) Field of Classification Search
CPC ..... F17C 3/085; F17C 13/006; F17C 2270/0536; F17C 2203/015; F17C 2201/0104; F25B 19/005
See application file for complete search history.

(56) References Cited

U.S. PATENT DOCUMENTS 4,837,541 A * 6/1989 Pelc ..... F17C 3/085 174/15.6
4,878,351 A * 11/1989 Weber ..... F17C 3/085 62/297
(Continued)

FOREIGN PATENT DOCUMENTS

CN 104251980 A 12/2014
CN 204130294 U 1/2015
(Continued)

OTHER PUBLICATIONS

First Office Action in Chinese Application No. 201610158171.6 dated Apr. 1 , 2019, 12 pages.

*Primary Examiner* — Stephen J Castellano
(74) *Attorney, Agent, or Firm* — Metis IP LLC

(57) ABSTRACT

A cryostat for a superconducting magnet system is provided. The cryostat may include an outer vessel and an inner vessel suspended within the outer vessel. A space may be defined by the outer vessel and the inner vessel. The cryostat may include multiple first support elements and one or more second support elements. The strength of the first supporting element may be larger than that of the second support elements. The inner vessel and the outer vessel may be connected by two opposite ends of a first support element and two opposite ends of a second support element, respectively. The number of the first support elements in the lower part of the space is different from the number of the first support elements in the upper part of the space.

19 Claims, 13 Drawing Sheets

(51) Int. Cl.
*F25B 19/00* (2006.01)
*F17C 3/08* (2006.01)

(52) U.S. Cl.
CPC ..... *F17C 2201/0104* (2013.01); *F17C 2203/015* (2013.01); *F17C 2270/0536* (2013.01)

(56) References Cited

U.S. PATENT DOCUMENTS

| | | | | |
|---|---|---|---|---|
| 6,185,808 | B1 * | 2/2001 | Ranze ..... | F17C 3/04 220/23.89 |
| 8,028,853 | B2 | 10/2011 | Hobbs et al. | |
| 8,511,632 | B2 | 8/2013 | Derakhshan et al. | |
| 2012/0289406 | A1 | 11/2012 | Wang et al. | |

FOREIGN PATENT DOCUMENTS

| | | | |
|---|---|---|---|
| CN | 104779030 | A | 7/2015 |
| CN | 105139992 | A | 12/2015 |
| JP | S6288379 | A | 4/1987 |
| JP | S63261706 | A | 10/1988 |

* cited by examiner

CRYOSTAT FOR SUPERCONDUCTING MAGNET SYSTEM

CROSS-REFERENCE TO RELATED APPLICATIONS

This application claims priority of Chinese Patent Application No. 201610158171.6 filed on Mar. 18, 2016, the contents of which are hereby incorporated by reference.

TECHNICAL FIELD

The present disclosure relates to a superconducting magnet system, and more particularly, to a cryostat of a superconducting magnet system.

BACKGROUND

Magnetic resonance imaging (MRI) is widely used in the medical imaging field. When an object, e.g., a human body, is placed in a main magnetic field, the hydrogen atoms in the object may be polarized. A pulse of radio-frequency (RF) may excite hydrogen atoms in the object, causing the hydrogen atoms to resonate and absorb energy. When the RF pulse is removed, the hydrogen atoms may emit a RF signal with a certain frequency, and release at least part of the energy absorbed. A receiver placed outside the object may receive the emitted RF signal, based on which a magnetic resonance (MR) image may be produced.

MRI may produce images in, for example, the traverse plane, the sagittal plane, the coronal plane, or other planes essentially without an adverse impact on an object by exposing the object to radiation.

A magnet is a component in a magnetic resonance imaging system to produce a stable magnetostatic field. Superconducting magnets are widely used in MRI systems. The basic principle is to immerse one or more coils formed by a superconducting material in liquid helium at an extremely low temperature (about 4K), then to energize to coils to produce a magnetic field. The liquid helium and the coils may be held within a cryostat. Liquid helium is expensive and volatile, and so it is desirable to thermal isolate the interior from exterior ambient temperature condition to reduce boiling off helium.

FIG. 1A through FIG. 1D show a traditional cryostat, which has a multi-layer structure. FIG. 1A is a front view partly in section of a traditional cryostat, FIG. 1B illustrates the internal multiple layers structure and the connection of the traditional cryostat, FIG. 1C is a simplified schematic structure diagram of the traditional cryostat, and FIG. 1D is a side view of FIG. 1C. As shown in FIG. 1A through FIG. 1D, the cryostat includes an outer vessel 110 and an inner vessel 120. The inner vessel 120 may be configured to hold a cryogenic medium. One thermal shielding layer 130 may be employed between the inner vessel 120 and the outer vessel 110. The inner vessel 120 and the thermal shielding layer 130 are supported spaced apart from one another with multiple support elements within the outer vessel 110. The suspension support elements include multiple support elements 140 (represented by lines with black dot ends) placed radially and multiple support elements 150 (represented by lines with black triangle ends) placed axially. As shown in FIG. 1B, the support elements 150 placed axially may be a rod. The support elements 140 and the support elements 150 should be strong enough to withstand the gravity of the inner vessel 120, as well as the shock load during transportation, or a combination thereof. The shock load may be multiple times of the gravity of the inner vessel 120. Some extra preload may be applied to the support elements in advance to prevent tension losing at a low temperature. In this kind of cryostat embodiment the force of the suspension system is relatively simple and could be calibrated easily, but the number of support elements is large. Merely by way of example, there may be sixteen support elements, including eight support elements 140 placed radially and eight support elements 150 placed axially (as shown in FIG. 1C and FIG. 1D, because the traditional cryostat may be a symmetrical system, part of the support elements may overlap in the front view and the side view of the cryostat). The large number of support elements may result in a complicated system, a cumbersome assembly process, and high cost. Moreover, a large number of support elements may import more heat load into the inner vessel, which would degrade the stability of the thermal system and more cryogen loss.

SUMMARY

An aspect of the present disclosure relates to a superconducting magnet cryostat. The superconducting magnet cryostat may include an outer vessel and an inner vessel. The inner vessel may be suspended within the outer vessel. A space may be defined by the outer vessel and the inner vessel. In some embodiments, the superconducting magnet cryostat may further include one or more first support elements and one or more second support elements. The strength of the first support elements may be different from that of the second support elements. In some embodiments, the strength of the first support element may be larger than the strength of the second support elements. The inner vessel and the outer vessel may be connected by two opposite ends of the first support element and two opposite ends of the second support element respectively. In some embodiments, the number of the first support elements in a lower part of the space may be greater than the number of the first support elements in the upper part of the space. In some embodiments, the number of the first support elements in the upper part of the space may be greater than the number of the first support elements in the lower part of the space. In some embodiments, the number of the first support elements in a lower part of the space may be the same with the number of the first support elements in the upper part of the space.

In some embodiments, the second support elements may be placed between planes defined by the corresponding ends of the first support elements in the lower part of the space. In some embodiments, the second support elements may be placed between planes defined by the corresponding ends of the first support elements in the upper part of the space.

In some embodiments, the second support elements may be merely placed in the lower part of the space or in the upper part of the space between the outer vessel and the inner vessel. In some embodiments, the first support elements may be placed symmetrically about a plane defined by the second support elements.

In some embodiments, there may be at least six first support elements in the space defined by the outer vessel and the inner vessel. In some embodiments, there may be four first support elements in the lower part of the space and two first support elements in the upper part of the space.

In some embodiments, there may be at least two second support elements in the space defined by the outer vessel and the inner vessel.

In some embodiments, the first support elements may be made of high-strength alloy or composite, including glass fibers, carbon fibers or polyphenylene terephthalamide fibers.

In some embodiments, the first support elements may be in the form of rods or bands. In some embodiments, the second support elements may be rods.

In some embodiments, the tensile strength or the compressive strength of a first support element may be larger than the tensile strength or the compressive strength of a second support element.

In some embodiments, the cross sectional areas of a first support element and a second support element may be the same or different. In some embodiments, the cross sectional area of a first support element may be larger than the cross sectional area of a second support element.

In some embodiments, in a Cartesian space, the axial direction of the superconducting magnet cryostat may be defined as the Z axis. In some embodiments, the first support elements may be symmetrical about an XY datum plane through the center of the inner vessel from a front view. In some embodiments, the first support elements may be symmetrical about a YZ datum plane through the center of the inner vessel from a right side view. In some embodiments, the second support elements may be symmetrical about an XY datum plane through the center of the inner vessel from a front view. In some embodiments, the first support elements in the upper part of the space and the first support elements in the lower part of the space may be asymmetrical about an XZ horizontal datum plane through the center of the inner vessel from. In some embodiments, the first support elements in the upper part of the space may be placed on an XY datum plane through the center of the inner vessel from a front view. In some embodiments, the second support elements may be placed on a YZ datum plane through the center of the inner vessel from a right side view.

In some embodiments, the length of a first support element may be 300-800 millimeters. In some embodiments, the cross sectional area of a first support element may be 50-300 square millimeters.

In some embodiments, the length of a second support element may be 200-800 millimeters. In some embodiments, the cross sectional area of a second support element may be 10-100 square millimeters.

In some embodiments, a shielding layer may be employed for shielding thermal radiation. In some embodiments, the shielding layer may be placed between the inner vessel and the outer vessel. In some embodiments, the first support elements and the second support elements may pass through the shielding layer perpendicularly or obliquely.

In some embodiments, one opposite end of a second support element may be fixed at an end of the inner vessel along the Z axis. In some embodiments, one opposite end of a second support element may be fixed at a distance from the end of the inner vessel along the Z axis. In some embodiments, the distance may be 50-100 millimeters. In some embodiments, one opposite end of the second support elements may be fixed at a distance from an XY datum plane through the center of the inner vessel from a front view. In some embodiments, the distance may be not less than one quarter of the length of the inner vessel.

In some embodiments, the first support elements and the second support elements may be pre-loaded in advance.

In some embodiments, the angle formed between the second support elements and a horizontal datum plane (e.g., an XZ datum plane) may be smaller than the angle formed between the first support elements and the horizontal datum plane. In some embodiments, the angle between the first support elements in the upper part of the space and a vertical datum plane (e.g., an XY datum plane vertical to the Z axis) may be smaller than the angle between the second support elements and the vertical datum plane.

In some embodiments, the first support elements in the upper part of the space and/or the first support elements in the lower part of the space may be symmetrical about the plane defined by the second support elements.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

In the following detailed description, numerous specific details are set forth by way of examples in order to provide a thorough understanding of the relevant disclosure. However, it should be apparent to those skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but to be accorded the widest scope consistent with the claims.

It will be understood that the term "system," "engine," "unit," "module," and/or "block" used herein are one method to distinguish different components, elements, parts, section or assembly of different level in ascending order. However, the terms may be displaced by other expression if they may achieve the same purpose.

It will be understood that when a unit, engine, module or block is referred to as being "on," "connected to," or "coupled to" another unit, engine, module, or block, it may be directly on, connected or coupled to, or communicate with the other unit, engine, module, or block, or an intervening unit, engine, module, or block may be present, unless the context clearly indicates otherwise. As used herein, the term "and/or" includes any and all combinations of one or more of the associated listed items.

The terminology used herein is for the purposes of describing particular examples and embodiments only, and is not intended to be limiting. As used herein, the singular forms "a," "an," and "the" may be intended to include the plural forms as well, unless the context clearly indicates otherwise. It will be further understood that the terms "include," and/or "comprise," when used in this disclosure, specify the presence of integers, devices, behaviors, stated features, steps, elements, operations, and/or components, but do not exclude the presence or addition of one or more other integers, devices, behaviors, features, steps, elements, operations, components, and/or groups thereof.

Figure 1A:
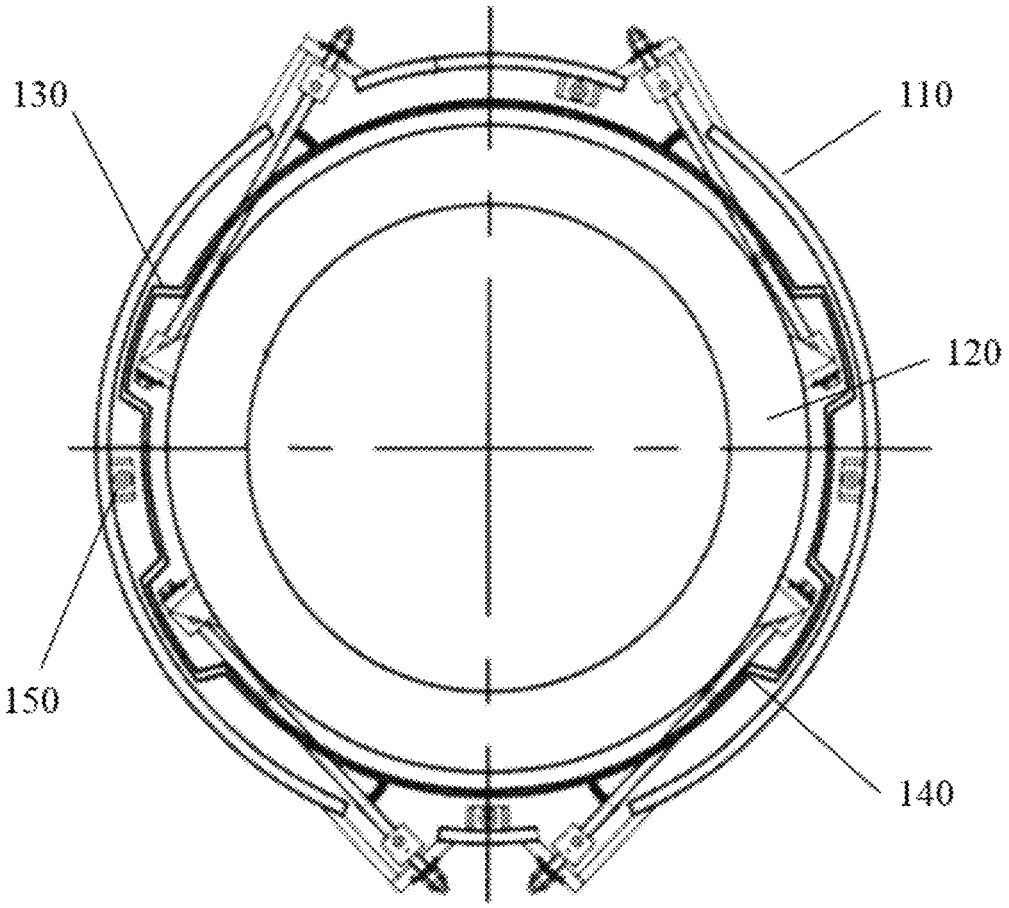
FIG. 1A through FIG. 1D illustrate various views of a traditional superconducting magnet cryostat.
Figure 1B:
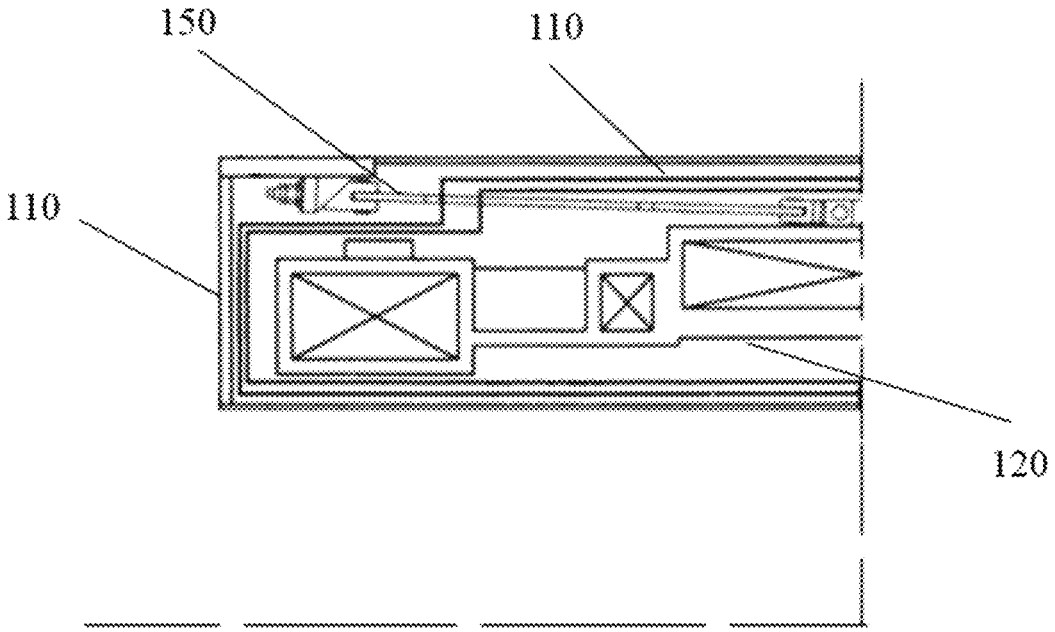
Figure 1C:
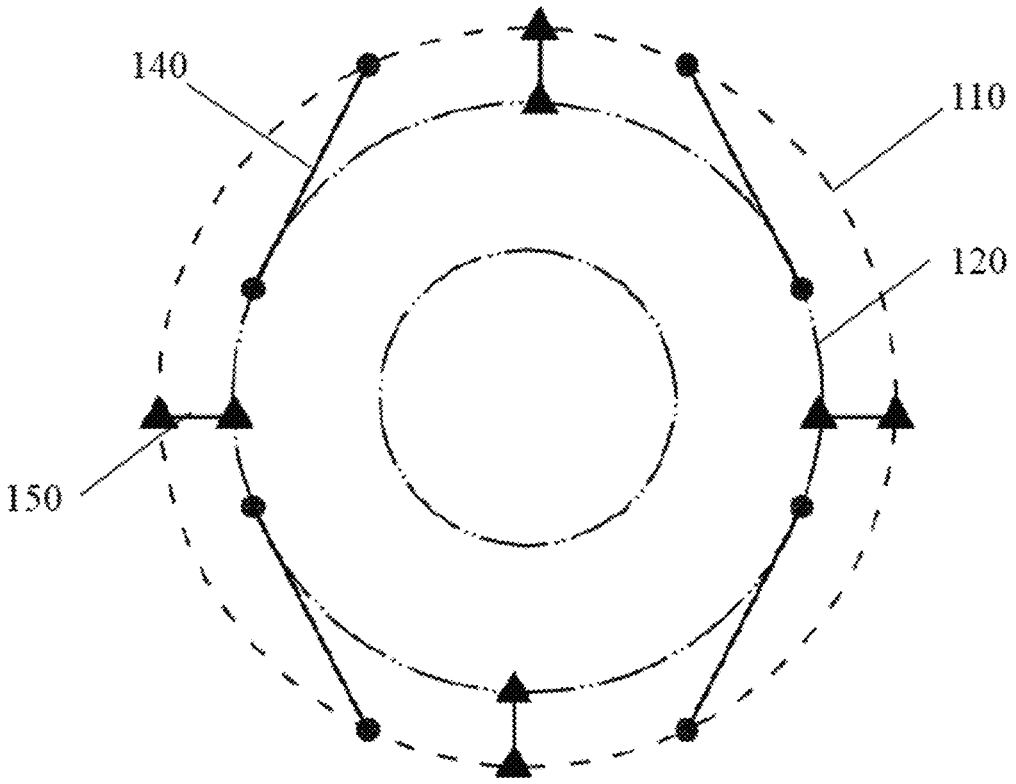
Figure 1D:
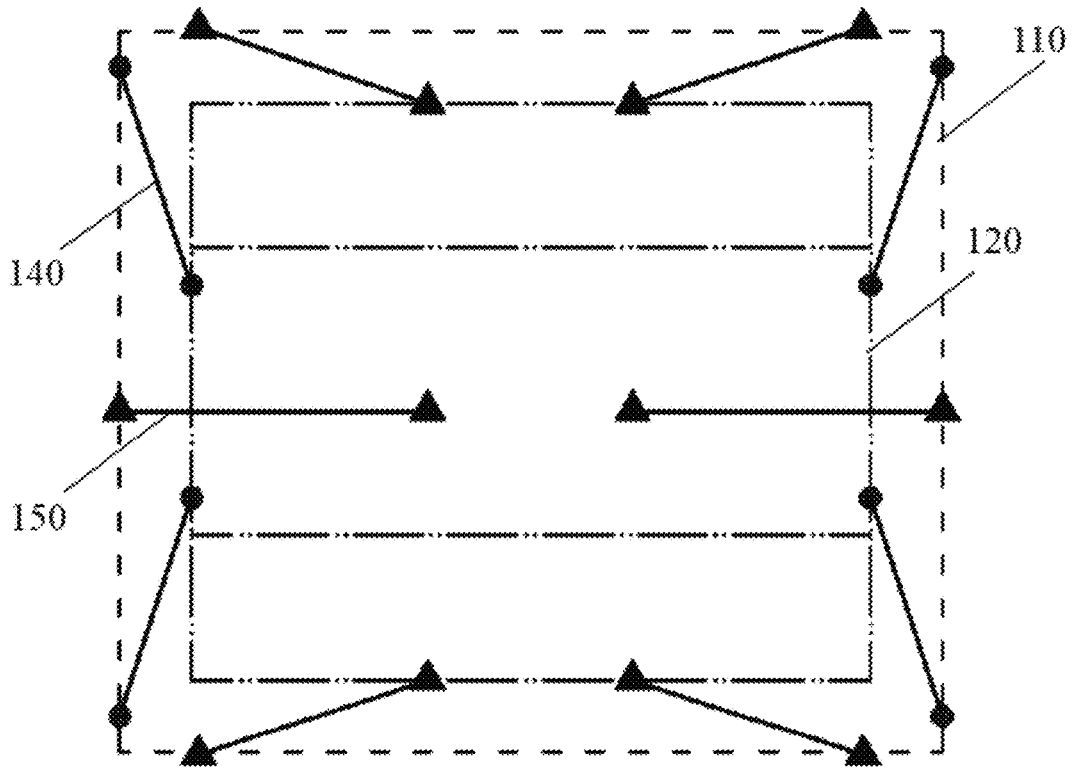
Figure 2:
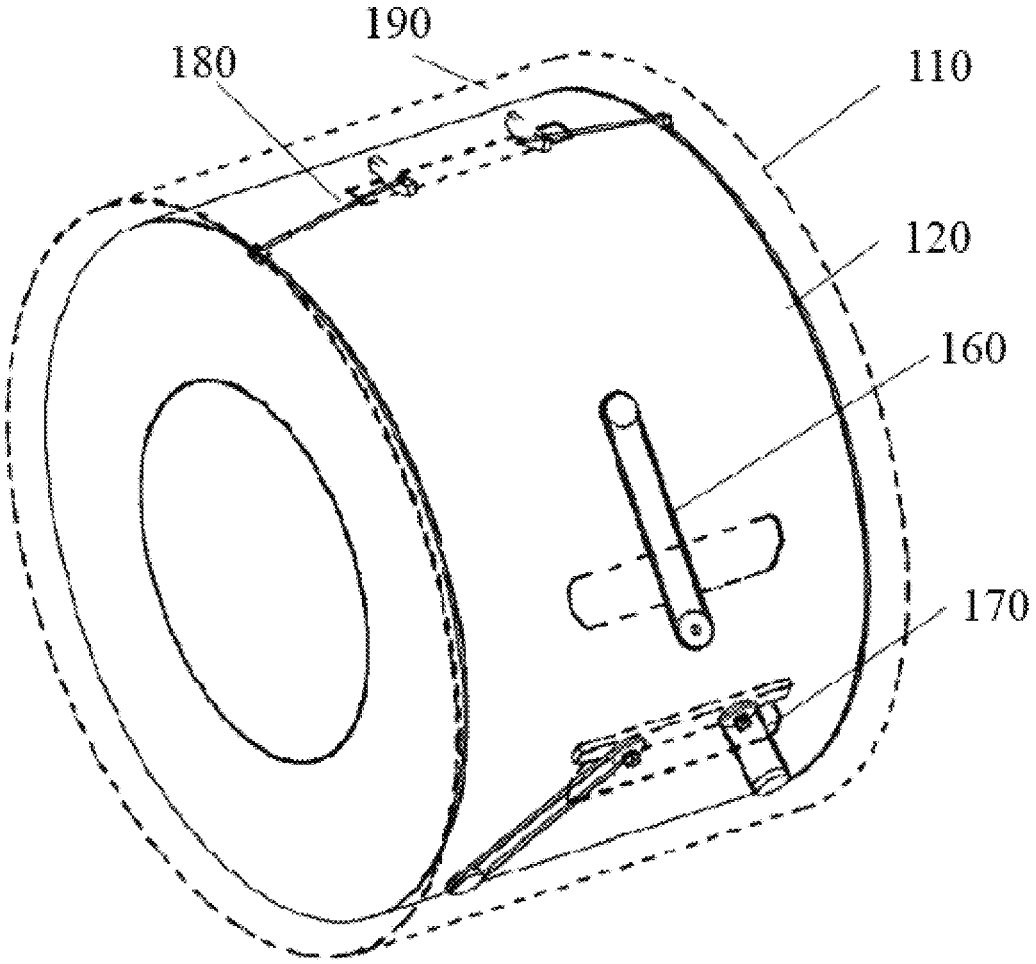
FIG. 2 illustrates an exemplary cryostat according to some embodiments of the present disclosure.

FIG. 2 is an exemplary cryostat according to some embodiments of the present disclosure. The cryostat may be part of an MRI system enclosing one or more superconducting magnets (or referred to as a superconducting magnet system). The cryostat may also be part of a superconducting magnet system other than an MRI system. As shown in FIG. 2, the exemplary cryostat may include an outer vessel 110 and an inner vessel 120. The inner vessel 120 may be suspended within the outer vessel 110. A space 190 may be defined by the outer vessel 110 and the inner vessel 120. In some embodiments, the inner vessel 120 may be used to hold a cryogenic medium, such as, for example, liquid helium. The space 190 between the inner vessel 120 and the outer vessel 110 may be set as vacuum.

Figure 5:
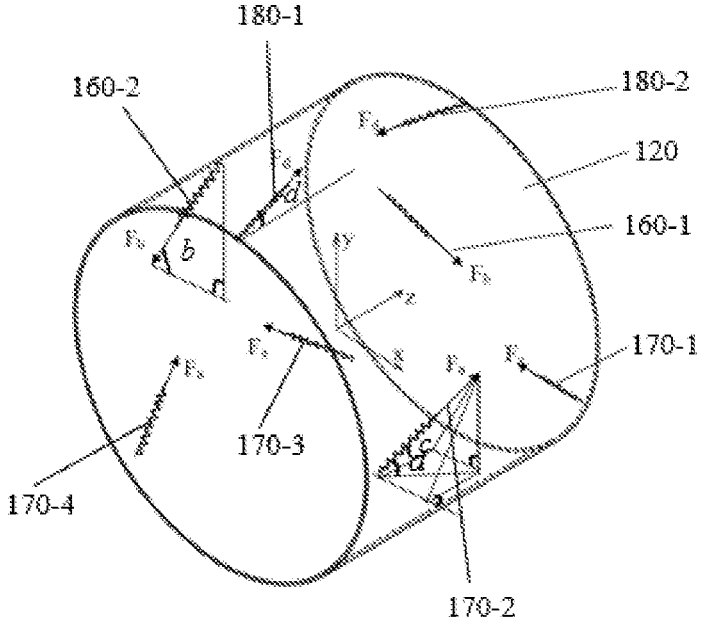
FIG. 5 illustrates exemplary positions and forces of the support elements according to some embodiments of the present disclosure.

In some embodiments, the cryostat may include one or more first support elements 160/170. In some embodiments, the cryostat may include one or more second support elements 180. As used herein, the first support elements 160 may refer to the first support elements in the upper part of the space 190, and the first support elements 170 may refer to the first support elements in the lower part of the space 190. As used herein, the upper part of the space 190 may refer to the portion of the space 190 that is with respect to the direction in which the force may be largest. As used herein, the lower part of the space 190 may refer to the portion of the space 190 that is with respect to the direction in which the force may be smallest. The locations of the first support elements and/or the second support elements may include but are not limited to the upper and/or lower part of the space. In some embodiments, the locations may be adjusted to the right and/or left part according to the structure and/or the directions of forces. It is understood that the upper part of the space 190 and the lower part of the space 190 may be used for convenience and illustration purposes, and are not intended to indicate that when the cryostat is installed in an MM system (or an superconducting magnet system) or when the MRI system (or an superconducting magnet system) is in operation, the upper part is above the lower part. An exemplary cryostat, as illustrated in FIG. 5, may include two first support elements 160, four first support elements 170, and two second support elements 180. The first support elements 160 may include a first support element 160-1 and a first support element 160-2. The first support elements 170 may include a first support element 170-1, a first support element 170-2, a first support element 170-3, and a first support element 170-4. The second support elements may include a second support element 180-1 and a second support element 180-2. The support elements 160, 170, and 180 may be configured to support the inner vessel 120. In some embodiments, a shielding layer (not shown in FIG. 2) may be placed in the space 190 between the inner vessel 120 and the outer vessel 110 to reflect thermal radiation. In some embodiments, the first support elements 160/170 may extend through the shielding layer perpendicularly or obliquely. In some embodiments, the second support elements 180 may extend through the shielding layer perpendicularly or obliquely.

In some embodiments, a first support element 160/170 may be a strong support element or a weak support element. In some embodiments, a second support element 180 may be a strong support element or a weak support element. As used herein, a strong support element may have a large strength such that it may withstand a large load. In some embodiments, a strong support element may be a band or a rod. In some embodiments, the band and/or rod may be made of fiber reinforced composite material. In some embodiments, the band and/or rod may be made of alloy. In some embodiments, an alloyed rod may be with high strength and large cross sectional area. For instance, a strong support element may be a fiber reinforced plastic (FRP) band. The carrying capacity of a FRP band may be 10-20 tons. The cross sectional area of a strong support element (e.g., a FRP rod) may be at least 10 square millimeters, or at least 20 square millimeters, or at least 30 square millimeters, or at least 40 square millimeters, or at least 50 square millimeters. A weak support element may be placed at a location where the force may be relatively small. The strength of a weak support element may be small. In some embodiments, a weak support element may be a rod with a small cross sectional area. In some embodiments, a weak support element may be made of a same material as a strong support element. In some embodiments, a weak support element may be made of a material different from the material of a strong support element. For instance, the rods may be made of stainless steel. The carrying capacity of a weak support element (e.g., a stainless steel rod) may be 1-3 tons. The cross sectional area of a weak support element (e.g., a stainless steel rod) may be smaller than 50 square millimeters, or smaller than 40 square millimeters, or smaller than 30 square millimeters, or smaller than 20 square millimeters.

In some embodiments, both the first support elements 160 in the upper part of the space and the first support elements 170 in the lower part of the space may be strong support elements. In some embodiments, the first support elements 160 and the first support elements 170 may be a same kind of strong support elements. As used herein, two support elements of a same kind may indicate that the support elements are the same in terms of material, shape, and the cross sectional area. In some embodiments, the first support elements 160 in the upper part of the space and the first support elements 170 in the lower part of the space may be different kinds of strong support elements. The first support elements 160 in the upper part of the space and the first support elements 170 in the lower part of the space may withstand different loads because of some factors, including, e.g., spatial positions. In some embodiments, the first support elements 160 in the upper part of the space and the first support elements 170 in the lower part of the space may be made of different materials. In some embodiments, the first support elements 160 in the upper part of the space and the first support elements 170 in the lower part of the space may be with different shapes and/or cross sectional areas. In some embodiments, the first support elements 160 and/or 170 may be weak support elements. In some embodiments, the second support elements 180 may be weak support elements. In some embodiments, the second support elements 180 may be strong support elements. Merely by way of example, in some embodiments, the first support elements 160 and/or 170 may be strong support elements, and the second support elements 180 may be strong support elements. The first support elements 160 in the upper part of the space, the first support elements 170 in the lower part of the space, and the second support elements 180 may be a same kind of strong support elements or different kinds of strong support elements. In some embodiments, the first support elements 160 and/or 170 may be strong support elements, and the second support elements 180 may be week support elements. The first support elements 160 in the upper part of the space and the first support elements 170 in the lower part of the space may be a same kind of strong support elements or different kinds of strong support elements. In some embodiments, the first support elements 160 and/or 170 may be weak support elements, and the second support elements 180 may be week support elements. The first support elements 160 in the upper part of the space, the first support elements 170 in the lower part of the space, and the second support elements 180 may be a same kind of weak support elements or different kinds of weak support elements.

Figure 3:
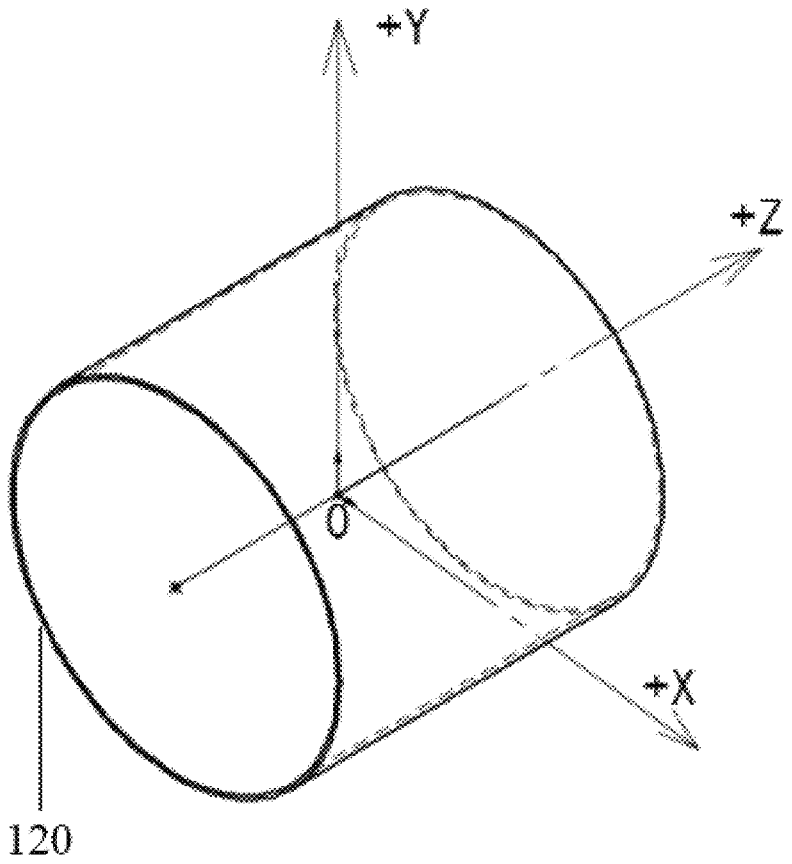
FIG. 3 illustrates a Cartesian space with the origin at the geometric center of the inner vessel and the outer vessel according to some embodiments of the present disclosure.

FIG. 3 shows a Cartesian space. As illustrated, the geometric center "O" of the inner vessel 120 may be chosen as the origin of axis. For illustration purposes, the X axis may be along the horizontal direction, the Y axis may be along the vertical direction, and the Z axis may be along the axial direction of the cryostat. A horizontal datum plane may refer to a plane that may be perpendicular to the direction of gravity. A first vertical datum plane may refer to a plane that may be perpendicular to the horizontal datum plane and perpendicular to the axis of the inner vessel. A second vertical datum plane may refer to a plane that may be perpendicular to the horizontal datum plane and parallel to the axis of the inner vessel. As shown in FIG. 3, the XY datum plane may be the first vertical datum plane, the YZ datum plane may be the second vertical datum plane, and the XZ datum plane may be the horizontal datum plane. The horizontal/vertical datum planes may include datum planes that may be through the center of the inner vessel 120 and datum planes that may be not through the center of the inner vessel 120.

Figure 4A:
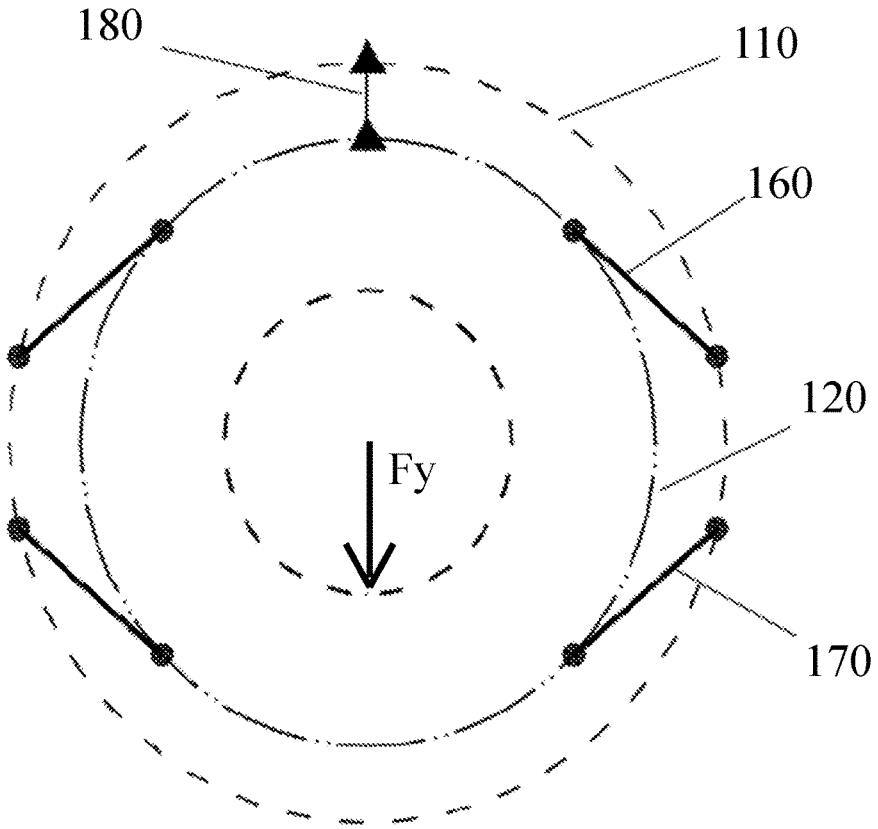
FIG. 4A and FIG. 4B illustrate an inner vessel, an outer vessel, and support elements according to some embodiments of the present disclosure.
Figure 4B:
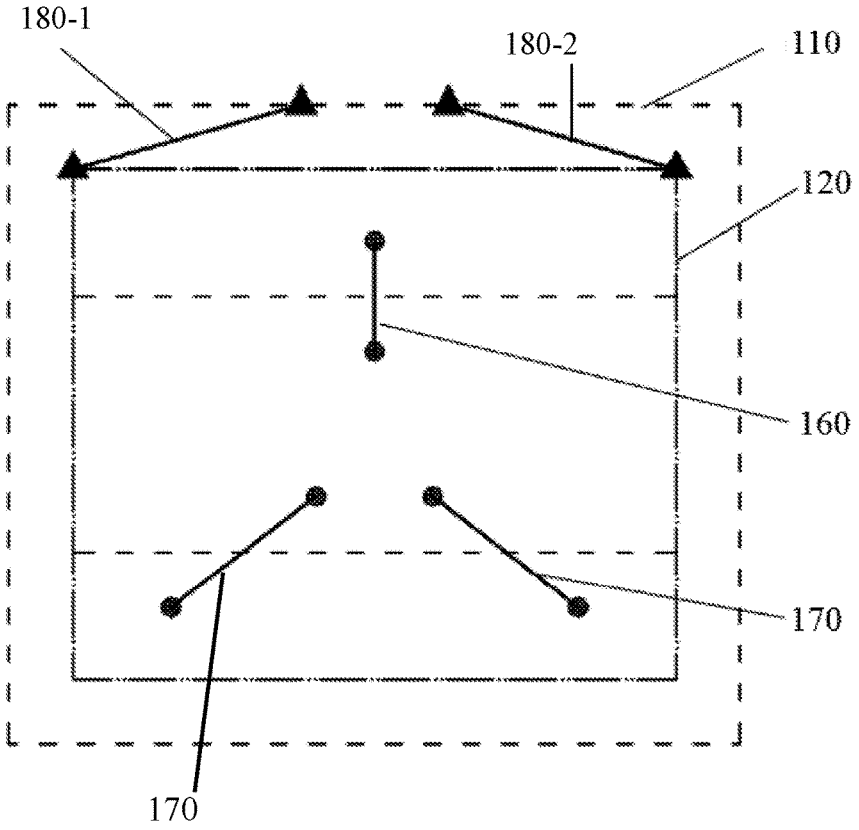

FIG. 4A shows a front view of the exemplary cryostat shown in FIG. 2 and FIG. 4B shows a right side view of the exemplary cryostat shown in FIG. 2. As shown in FIG. 4A and FIG. 4B, two opposite ends of a first support element 160 or 170 (represented by black dot ends) may connect the inner vessel 120 to the outer vessel 110, respectively. Two opposite ends of a second support element 180 (represented by black triangle ends) may connect the inner vessel 120 to the outer vessel 110, respectively. The number of the first support elements 160/170 and the number of the second support elements 180 may be arbitrary. Merely by way of example, the number of the first support elements may be six, and the number of the second support elements may be two. In some embodiments, the number of the first support elements 170 in the lower part of the space may be larger than the number of the first support elements 160 in the upper part of the space. For instance, the number of the first support elements 170 may be four and the number of the first support elements 160 may be two (as shown in FIG. 5). In some embodiments, the first support elements 160/170 and/or the second support elements 180 may be placed symmetrically with respect to one or more datum planes through the center of the inner vessel 120 or asymmetrically. In some embodiments, the first support elements 170 may be symmetrical or asymmetrical with respect to an XY datum plane through the center of the inner vessel 120. In some embodiments, the first support elements 170 may be symmetrical or asymmetrical with respect to a YZ datum plane through the center of the inner vessel. In some embodiments, the first support elements 160 may be placed on the XY datum plane through the center of the inner vessel. In some embodiments, the first support elements 160 may be symmetrical or asymmetrical with respect to the YZ datum plane through the center of the inner vessel.

In some embodiments, the second support elements 180 may be placed between planes defined by the corresponding ends of the first elements 160 in the upper part of the space 190 or may be placed between the planes defined by the corresponding ends of the first elements 170 in the lower part of the space 190. In some embodiments, the second support elements 180 may be placed on the YZ datum plane and may be symmetrical or asymmetrical with respect to the XY datum plane. The angle (see, e.g., the angle din FIG. 5) between the second support elements 180 and the horizontal XZ datum plane may be a value including, e.g., from 0° to 90°, from 0° to 60°, from 60° to 90°, from 0° to 30°, from 30° to 60°, from 0° to 15°, from 15° to 30°, etc. As shown in FIG. 4B, the mounting point connecting the second support elements 180 (i.e., the second support element 180-1 and the second support element 180-2) with the inner vessel 120 may be located at the end of the inner vessel 120. In some embodiments, one opposite end of the second support elements 180 (i.e., the second support element 180-1' and the second support element 180-2' (not shown in FIG. 4B)) may be fixed at a distance from the XY datum plane through the center of the inner vessel 120. In some embodiments, the distance may be no smaller than one quarter of the length of, for example, the inner vessel 120.

In some embodiments, a support element, e.g., a first support element 160/170, or a second support element 180, may be pre-tensioned to prevent slacking during the cooling process and/or transport.

It should be noted that the above description about the cryostat is merely provided for the purposes of illustration, and not intended to limiting the scope of the present disclosure. For persons having ordinary skills in the art, multiple variations and modifications may be made under the teachings of the present disclosure. For example, the number and positions of the first support elements and second support elements may be arbitrary. In some embodiments, the second support elements 180 may be merely placed in the lower part of the space 190. In some embodiments, the second support elements 180 may be merely placed in the upper part of the space 190. In some embodiments, the second support elements 180 may be placed both in the upper part of the space 190 and the lower part of the space 190. In some embodiments, the first support elements 160/170 may be placed symmetrically or asymmetrically with respect to the plane defined by the second support elements 180. In some embodiments, the strength of the first supporting element 160/170 may be larger than the strength of the second support elements 180. In some embodiments, the strength of the first supporting element 160/170 may be equal to or smaller than the strength of the second support elements 180. In some other embodiments, the angle formed between the a first support element 160 in the upper part of the space and the horizontal XZ datum plane may be same with the angle formed between a first support elements 170 in the lower part of the space and the horizontal XZ datum plane. In some embodiments, the angles may be different according to different spatial positions of the support elements. However, those variations and modifications do not depart from the scope of the present disclosure.

Figure 6:
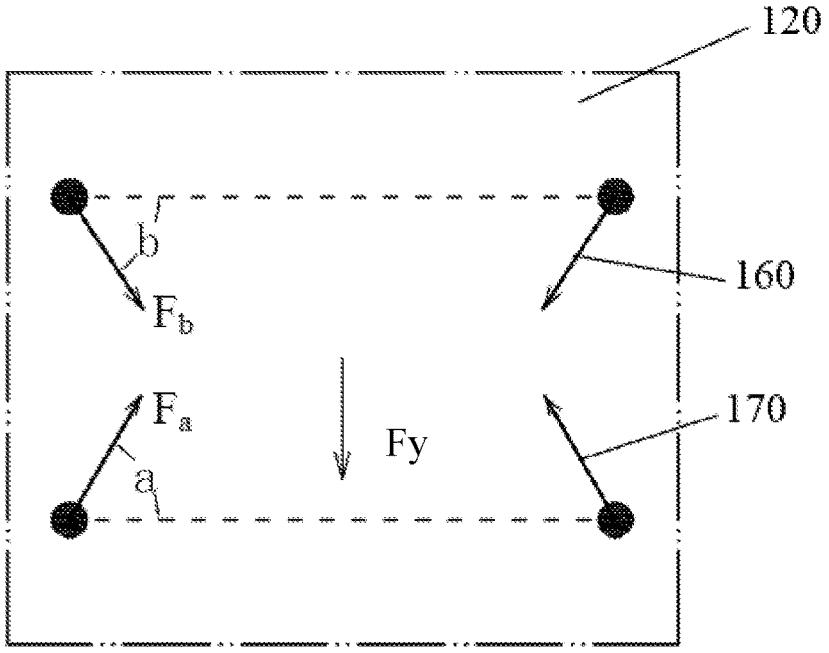
FIG. 6 illustrates exemplary reacting forces of the first support elements from a side view according to some embodiments of the present disclosure.
Figure 7:
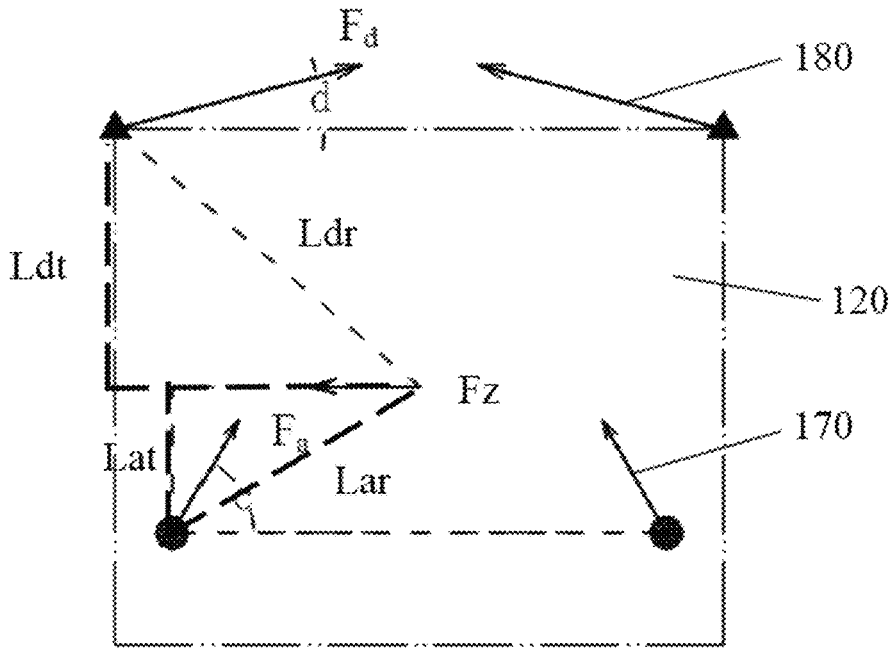
FIG. 7 illustrates exemplary reacting forces of the first support elements and the second support elements from a side view according to some embodiments of the present disclosure.

FIG. 5 shows exemplary forces the support elements 160/170/180 are subject to according to some embodiments of the present disclosure. FIG. 6 shows the exemplary reacting forces of the first support elements 160/170 under Y direction load case in the XY datum plane according to some embodiments of the present disclosure; FIG. 7 shows the reacting forces of the first support elements 170 and the second support elements 180 under Z direction load case according to some embodiments of the present disclosure.

For illustration purposes, the forces of each support element are be set forth in the following description. When the angle between the second support elements 180 and the horizontal XZ datum plane is small, the shifts of the inner vessel 120 in the X direction and/or the Y direction may generate little influence on the forces on the second support elements 180. As a result, the shock loads in the X/Y direction and the rotating loads in the RX/RY direction may mainly be withstood by the first support elements 160 and 170. As shown in FIG. 5, the angle between a first support element 170 and the horizontal XZ datum plane may be a, the angle between the first support element 170 and the Z axis may be c; the angle between a first support element 160 and the horizontal XZ datum plane may be b; and the angle between a second support element 180 and the Z axis may be d. Assuming the weight of the inner vessel 120 to be m, the number of the first support elements 170 to be $n_a$, the number of the first support elements 160 to be $n_b$, the force on the first support elements 170 to be $F_a$, the force on the first support elements 160 to be $F_b$, the pre-load on the first support elements 170 to be $F_{a0}$, and the pre-load on the first support elements 160 to be $F_{b0}$.

Merely by way of example, assume: $n_a$=4, $n_b$=2, a=b, and $F_{a0}$=$F_{b0}$=$F_0$. For brevity, the force generated by the gravity of the inner vessel is referred to as −1 g, where the sign "−" may denote that the force is along the −Y direction.

a) In some embodiments, when there is no shock load, the first support elements 170 in the lower part of the space 190 and the first support elements 160 in the upper part of the space 190 may withstand the gravity of the inner vessel 120 (i.e., 1 g).

b) In some embodiments, when the shock load is +5 g in the +Y direction, a resultant load may be +4 g in the +Y direction. In this case, the first support elements 160 may withstand a larger load than the first support elements 170. In some embodiments, the pre-load on the first support elements 170 may be set to a value to essentially entirely offset the force on the first support elements 170, and thus the force on each of the first support elements 160 may be 2 mg/sin(b). The pre-load on the first support elements 160 and 170, $F_0$, may be set at least as 2 mg/sin(b). As used herein, "essentially," as in "essentially entirely," with respect to a parameter or a feature may indicate that the variation is within 2%, or 5%, or 8%, or 10%, or 15% of the parameter or the feature.

c) In some embodiments, when the shock load is 5 g in the −Y direction, a resultant load may be 6 g in the −Y direction. In this case, the first support elements 170 may withstand a larger load than the first support elements 160. In some embodiments, the pre-load on the first support elements 160 may be set to a value to essentially entirely offset the force on the first support elements 160, and thus, the force on each of the first support elements 170 may be 3 mg/(2 sin(a)). The pre-load on the first support elements 160 and 170, $F_0$, may be at least 3 mg/(2 sin(a)).

Because the shock load may be +5 g in the +Y direction, or −5 g in the −Y direction, the pre-load $F_0$ may be the larger value of 2 mg/sin(b) and 3 mg/(2 sin(a)). If a=b, the pre-load on each of the first support elements 170 and 160 may be 2 mg/sin(a).

The force or load on a support element may be relevant to a suspension angle corresponding to a support element with respect to a datum plane (e.g., the angle a, the angle b, the angel c, or the angle din FIG. 5). For example, the adjustable range of the angle b between a first support element 160 on the XY datum plane and the XZ datum plane may be larger than the adjustable range of the angle between a first support element 170 and the XZ datum plane. The force or load on the strong elements may increase by, for example, no more than 10%, on the large shock load in +/−Y direction compared with a traditional suspension system. As used herein, there may be fewer first support elements 160 (e.g., four in the traditional suspension system, two in the present disclosure) according to some embodiments in the present disclosure. Merely by way of example, in a traditional vertically symmetrical suspension system as illustrated in FIG. 1A through FIG. 1D, $n_b$=$n_a$=4 and a=b. When the shock load may be 5 g in the −Y direction, the force on each of the first support elements 170 may be 3 mg/(2 sin(a)).

Based on the description above, when $n_b$ changes from 4 to 2 (i.e., in a traditional vertically symmetrical suspension system as illustrated in FIG. 1A through FIG. 1D, $n_b$ may be 4, and in the exemplary suspension system as illustrated in FIG. 2 through FIG. 7, $n_b$ may be 2), the force on the first support elements 160 may increase by 25%. The force on the support elements may be relevant to a suspension angle, i.e., the angle b. Therefore, the increasement of the force on the strong support elements may be little, e.g., no more than 10%, in the condition that the shock load in the Y direction may be largest.

Similarly, according to the compatibility conditions of deformation of the material mechanics, subject to the shock load in the X/Y directions and the rotating load of the RX/RZ, the force on the strong support elements may increase by a small amount compared with traditional suspension system, e.g., 5%, 10%, 15%, 20%, 25%, 30%, etc.

In some embodiments, subject to the shock load in the Z direction and/or the rotating load of the RX, the first support elements 160 on the XY datum plane may be not sensitive to the load in the Z direction and the rotation load of the RX. Thus, the second support elements 180 and the first support elements 170 may bear the shock load in the Z direction and the rotating load of the RX.

In some embodiments, the mounting point connecting a second support element 180 with the inner vessel 120 may be at the axial end of the inner vessel 120 along the Z axis. Fy (shown in FIG. 6) may represent a shock load in the Y direction; Fz may represent a shock load in the Z direction; Ldt may represent an arm of a force on the second support element 180-1 against Fz; Ldr may represent an arm of a force on the second support element 180-1 against the rotating load of RX; Lat may represent an arm of a force on the first support element 170-2 against Fz; and Lar may represent an arm of a force on the first support element 170-2 against the rotating load of RX. The angel, d (as shown in FIG. 5 and FIG. 7), between the second support element 180 and the horizontal XZ datum plane may be close to zero, such that the component in the Z direction of the force on the second support elements 180 may be $F_d \cos(d) \approx F_d$. Similarly, the component of the force in the Z direction provided by the first support elements 170 may be $F_a \cos(c)$. As shown in FIG. 7, with the arrangement of the first support elements 170 and the second support elements 180, the arm, Ldt, may be larger than the arm Lat and the arm Ldr may be larger than the arm Lar.

Even though the second support elements 180 include weak support elements with a small carrying capacity, the force on the second support elements 180 may increase by a certain amount that is within an allowable range with respect to the tension per-applied on them when the shock load in the Z direction and the rotating load in RX may exist. In some embodiments, the force on the second support elements 180 may increase by, for example, about 30%.

According to some embodiments of the present disclosure, the inner vessel 120 may move and/or rotate when some shock loads and rotating loads appear. Since the stiffness of the support elements may be large, the rotation angle and the displacement of the support elements may be relatively small and the effect may be neglected.

Figure 8A:
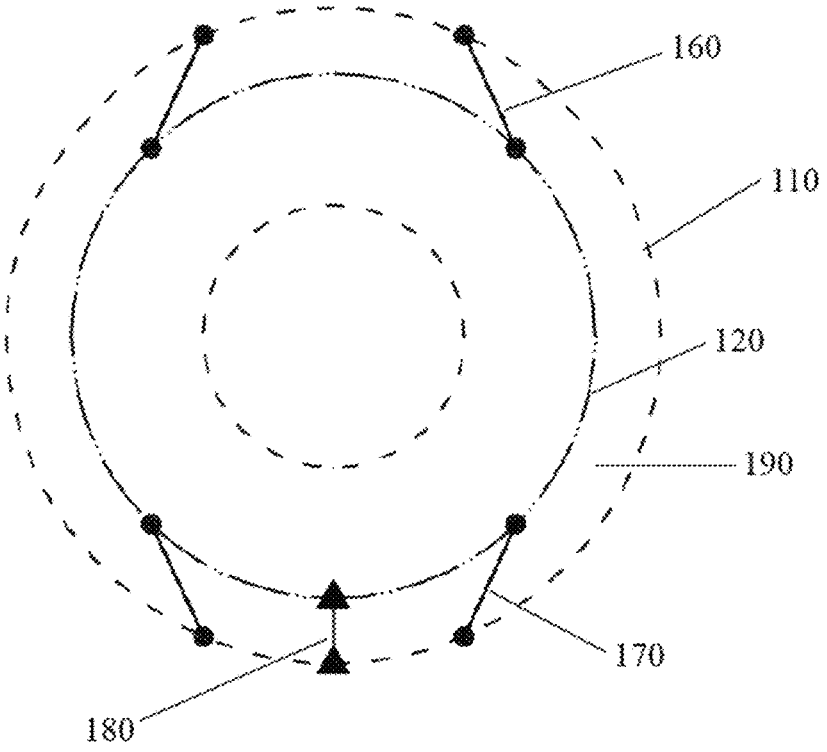
FIG. 8A and FIG. 8B illustrate an exemplary cryostat according to some embodiments of the present disclosure.
Figure 8B:
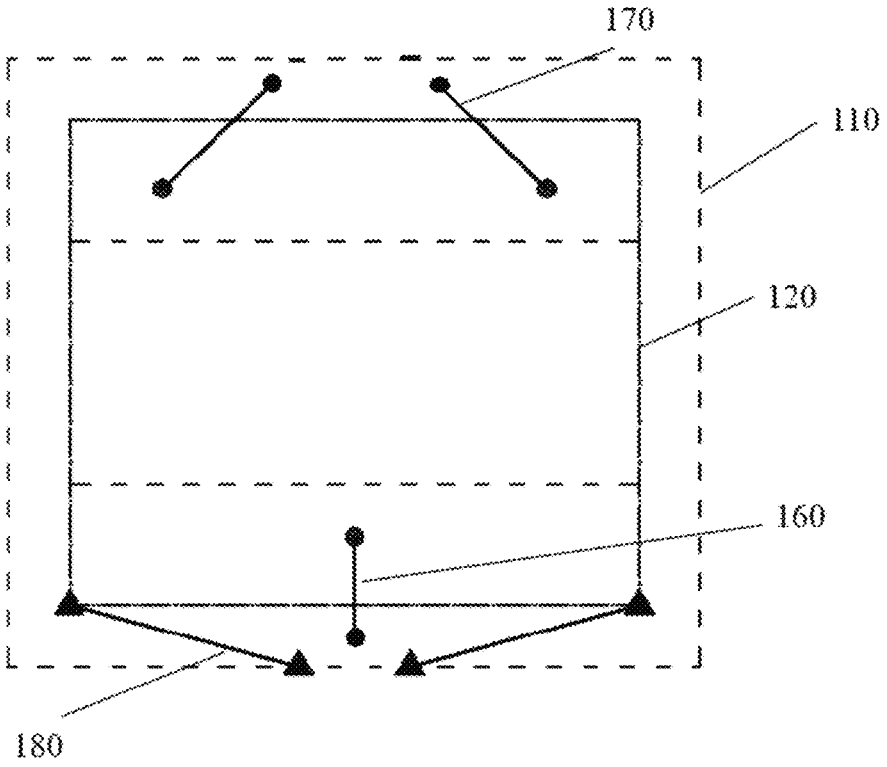

FIG. 8A and FIG. 8B illustrate an exemplary cryostat according to some embodiments of the present disclosure. As shown in FIG. 8A and FIG. 8B, the second support elements 180 may be placed in the lower part of the space 190, four first support elements 160 may be placed in the upper part of the space 190, and two first support elements 170 may be placed in the lower part of the space 190. The arrangement of the first support elements 160/170 and the second support elements 180 may be similar to the description in other examples.

It should be noted that the suspension system applied to the cryostat holding cryogenic medium according to the present disclosure is merely an example. In some embodiments, the arrangement of the support elements may be applicable in other environments in which a low temperature and isolation of thermal may be needed. For example, the arrangement of the support elements may be used to support the shielding layer of the superconducting magnet cryostat.

It should be noted that the suspension system described above is provided for the purposes of illustration, and not intended to limit the scope of the present disclosure. Apparently for persons having ordinary skills in the art, numerous variations and modifications may be conducted under the teaching of the present disclosure. However, those variations and modifications may not depart the protecting scope of the present disclosure.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various inventive embodiments. This method of disclosure, however, is not to be interpreted as reflecting an intention that the claimed subject matter requires more features than are expressly recited in each claim. Rather, inventive embodiments lie in less than all features of a single foregoing disclosed embodiment.

In some embodiments, the numbers expressing quantities of ingredients, properties such as molecular weight, reaction conditions, and so forth, used to describe and claim certain embodiments of the application are to be understood as being modified in some instances by the term "about," "approximate," or "substantially." For example, "about," "approximate," or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the present disclosure are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting affect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments disclosed herein are illustrative of the principles of the embodiments of the present disclosure. Other modifications that may be employed may be within the scope of the present disclosure. Thus, by way of example, but not of limitation, alternative configurations of the embodiments of the present disclosure may be utilized in accordance with the teachings herein. Accordingly, embodiments of the present disclosure are not limited to that precisely as shown and described.

What is claimed is:

1. A cryostat comprising:

an outer vessel;

an inner vessel suspended within the outer vessel;

a space defined by the inner vessel and the outer vessel, the space having an upper part and a lower part;

a plurality of first support elements comprising a first number of the first support elements located in the upper part of the space and a second number of the first support elements located in the lower part of the space, each of the plurality of first support elements having a first strength; and a second support element having a second strength, wherein the first strength of at least one of the plurality of first support elements is different from the second strength of the second support element, at least one of the first support elements located in a first part of the space is at a first oblique angle with an XY datum plane and at a second oblique angle with an XZ datum plane, and the first support elements located in a second part of the space are in the XY datum plane, the first part of the space being one of the lower part of the space or the upper part of the space, and the second part of the space being the other of the lower part of the space or the upper part of the space that is different from the first part, an origin of a three-dimensional coordinate system coincides with a center of the inner vessel of the cryostat, the three-dimensional coordinate system includes an X axis, a Y axis, and a Z axis that are perpendicular to each other and intersect at the origin, the X axis is a horizontal axis, the Y axis is a vertical axis, the Z axis coincides with the longitudinal axis of the inner vessel, the XY datum plane is defined by the X axis and the Y axis and perpendicular to the Z axis, the XZ datum plane is defined by the X axis and the Z axis, the inner vessel and the outer vessel are connected by two opposite ends of a first support element of the plurality of first support element, the inner vessel and the outer vessel are connected by two opposite ends of the second support element, and the first number is different from the second number.

2. The cryostat of claim 1, wherein the second number is four and the first number is at least two.

3. The cryostat of claim 1, comprising two second support elements.

4. The cryostat of claim 1, wherein the plurality of first support elements comprise a high-strength alloy or a composite.

5. The cryostat of claim 4, wherein the composite comprises glass fibers, carbon fibers, or polyphenylene terephthalamide fibers.

6. The cryostat of claim 1, wherein the first support elements comprise rods or bands.

7. The cryostat of claim 1, wherein the second support element is a rod.

8. The cryostat of claim 1, wherein the first strength of at least one of the plurality of first support elements is larger than the second strength of the second support element.

9. The cryostat of claim 1, wherein the first strength or the second strength is a tensile strength or a compressive strength.

10. The cryostat of claim 1, wherein the cross sectional area of at least one of the plurality of first support elements is larger than the cross sectional area of the second support element.

11. The cryostat of claim 1, wherein the length of the first support elements is 300-800 mm, and the cross sectional area of the first support elements is 50-300 $mm^2$.

12. The cryostat of claim 1, wherein the length of the second support element is 200-800 mm, and the cross sectional area of the second support element is 10-100 $mm^2$.

13. A cryostat comprising:

an outer vessel;

an inner vessel, suspended within the outer vessel;

a space defined by the inner vessel and the outer vessel, the space having an upper part and a lower part;

a plurality of first support elements; and a plurality of second support elements, wherein the strength of at least one of the first support elements is larger than the strength of at least one of the second support elements, at least one of the first support elements located in a first part of the space is at a first oblique angle with an XY datum plane and at a second oblique angle with an XZ datum plane, and the first support elements located in a second part of the space are in the XY datum plane, the first part of the space being one of the lower part of the space or the upper part of the space, and the second part of the space being the other of the lower part of the space or the upper part of the space that is different from the first part, an origin of a three-dimensional coordinate system coincides with a center of the inner vessel of the cryostat, the three-dimensional space includes an X axis, a Y axis, and a Z axis that are perpendicular to each other and intersect at the origin, the X axis is a horizontal axis, the Y axis is a vertical axis, the Z axis coincides with the longitudinal axis of the inner vessel, the XY datum plane is defined by the X axis and the Y axis and perpendicular to the Z axis, the XZ datum plane is defined by the X axis and the Z axis, the inner vessel and the outer vessel are connected by two opposite ends of a first support element of the plurality of first support elements, the inner vessel and the outer vessel are connected by two opposite ends of a second support element of the plurality of second support elements, and the number of the first support elements in the lower part of the space is larger than the number of the first support elements in the upper part of the space or the number of the first support elements in the upper part of the space is larger than the number of the first support elements in the lower part of the space.

14. The cryostat of claim 13, wherein the first support elements are symmetrically disposed with respect to the XY datum plane.

15. The cryostat of claim 13, wherein the second support elements are symmetrically disposed with respect to the XY datum plane.

16. The cryostat of claim 13, wherein the first support elements are symmetrically disposed with respect to a YZ datum plane defined by the Y axis and the Z axis.

17. The cryostat of claim 13, wherein the second support elements are placed in a YZ datum plane defined by the Y axis and the Z axis.

18. The cryostat of claim 13, wherein the first support elements in the upper part of the space and the first support elements in the lower part of the space are asymmetrically arranged about the XZ datum plane.

19. A cryostat comprising:

an outer vessel;

an inner vessel suspended within the outer vessel;

a space defined by the inner vessel and the outer vessel, the space having an upper part and a lower part;

a plurality of first support elements comprising a first number of the first support elements located in the upper part of the space and a second number of the first support elements located in the lower part, each of the plurality of first support elements having a first strength; and a second support element having a second strength, wherein the first strength of at least one of the plurality of first support elements is larger than the second strength of the second support element, the inner vessel and the outer vessel are connected by two opposite ends of a first support element of the plurality of first support element, the inner vessel and the outer vessel are connected by two opposite ends of the second support element, the first number is different from the second number, the angle between the second support element and an XZ datum plane is smaller than the angle between at least one of the plurality of first support elements and the XZ datum plane, and the angle between at least one of the plurality of first support elements an XY datum plane is smaller than the angle between the second support element and the XY datum plane, wherein an origin of a three-dimensional coordinate system coincides with a center of the inner vessel of the cryostat, the three-dimensional coordinate system includes an X axis, a Y axis, and a Z axis that are perpendicular to each other and intersect at the center of the inner vessel, the X axis is a horizontal axis, the Y axis is a vertical axis, the Z axis coincides with the longitudinal axis of the inner vessel, the XY datum plane is defined by the X axis and the Y axis and perpendicular to the Z axis, and the XZ datum plane is defined by the X axis and the Z axis.

* * * * *